US005825379A

United States Patent [19]

Kagami

[11] Patent Number: 5,825,379

[45] Date of Patent: Oct. 20, 1998

[54] INK JET PRINTER AND PRINTER HEAD HAVING MEANS FOR QUANTIFYING LIQUIDS AND MIXING LIQUIDS OUTSIDE THE PRINTER HEAD

[75] Inventor: Toshiki Kagami, Tokyo, Japan

[73] Assignee: Sony Corporation, Tokyo, Japan

[21] Appl. No.: 324,989

[22] Filed: Oct. 18, 1994

[30] Foreign Application Priority Data

Oct. 26, 1993 [JP] Japan ..... 5-266774

[51] Int. Cl.[6] ..... B41J 2/015

[52] U.S. Cl. ..... 347/20; 347/68; 347/54; 347/21

[58] Field of Search ..... 347/68, 95, 15, 347/7, 20, 21, 100, 101

[56] References Cited

U.S. PATENT DOCUMENTS

| | | | |
|---|---|---|---|
| 4,196,437 | 4/1980 | Hertz | 347/68 |
| 4,494,128 | 1/1985 | Vaught | 347/15 X |
| 5,371,529 | 12/1994 | Eguchi et al. | 347/68 |

FOREIGN PATENT DOCUMENTS

| | | | |
|---|---|---|---|
| 064881A2 | 11/1982 | European Pat. Off. | 347/20 |
| 6-122201 | 5/1994 | Japan | 347/15 |

*Primary Examiner*—Benjamin R. Fuller
*Assistant Examiner*—Charlene Dickens
*Attorney, Agent, or Firm*—Ronald P. Kananen

[57] ABSTRACT

In the ink jet printer head and the ink jet printer of this invention, accurate gradation printing can be performed at a high speed. The ink 34 is introduced to be supplied from the ink tank to a quantified liquid chamber 8 of the quantified part 2 via a liquid supply channel 15. When voltage is applied to the piezoelectric element 11, it is distorted in the height direction. However, since the upper side is fixed to the piezo element support 5, the piezoelectric element 11 elongates in the downward direction. Therefore, the piston 12 is pressed down and the volume of the quantifying part liquid chamber 8 is reduced, so that the ink 34 is flowed out from the liquid flow channel 14 in the amount corresponding to the reduced volume, namely the quantified ink 34. This quantified ink 34 is mixed with the transparent solvent 35 discharged from the base 1.

22 Claims, 12 Drawing Sheets

INK JET PRINTER AND PRINTER HEAD HAVING MEANS FOR QUANTIFYING LIQUIDS AND MIXING LIQUIDS OUTSIDE THE PRINTER HEAD

BACKGROUND OF THE INVENTION

1. Field of the Invention

The present invention relates to an ink jet printer head and an ink jet printer for printing with a mixed liquid in which a transparent solvent and an ink are quantified and mixed.

2. Description of the Related Art

For example, with respect to an on-demand ink jet printer, ink is discharged by using pressure caused by the distortion of an electrostrictive element (a piezoelectric element or a piezo element) and pressure of a bubble generated by heating and boiling by a heating element.

In the on-demand ink jet printer, gradation is represented by one kind of ink. More specifically, in an ink jet printer which can discharge only one kind of liquid (ink), gradation representation by one dot is performed by area gradation that the size of one dot of ink sticking to the material to be printed is controlled by controlling the amount of ink discharged at one time.

However, since it is extremely difficult to perform fine control of ink discharged at one time, there have been problems as rich gradation printing cannot be obtained, representation capabilities are poor in the highlighted portion, and so on.

Therefore, an ink jet printer has been developed which performs printing by discharging a mixed liquid of a transparent solvent and ink.

In such an ink jet printer, printing is performed using in-dot density gradation in which either the transparent solvent or the ink, e.g., ink, is quantified in accordance with a desired gradation representation, and mixed with the predetermined transparent solvent as the other liquid, and determined by the definite mixed liquid amount to perform discharge printing.

The applicant of the present invention has already disclosed an ink jet printer which makes use of, for example, electrical permeation to quantify ink (or transparent solvent), as an ink jet printer using a mixed liquid mixing two (or more) liquids as described above, in U.S. patent application Ser. No. 07/961,982 which is pending.

Here, electrical permeation is referred to as a phenomenon in which a vessel filled with the electrolyte solution is provided with a porous barrier membrane to partition the chamber into two, and an electrode plate is inserted into left and right electrolyte solutions so that, when a voltage is applied, the electrolyte solution moves from one chamber to another via the porous barrier membrane.

Electrical permeation allows relatively accurate quantification because the permeation amount or movement amount of the electrolyte solution stands in proportion to the amount of flowed electricity.

However, the frequency response of electrical permeation phenomenon is slow compared with, for example, a piezoelectric element, thereby making it difficult to increase the printing speed.

Moreover, ink and transparent solution are mixed in transparent solution, so that they come to be mixed spontaneously.

SUMMARY OF THE INVENTION

In view of the foregoing, an object of this invention is to provide an ink jet printer head and an ink jet printer which can perform accurate gradation printing at a high speed.

Another object of the invention is to provide an ink jet printer head and an ink jet printer which can prevent the spontaneous mixing of ink and transparent solution.

The foregoing objects and other objects of the invention have been achieved by the provision of an ink jet printer head, comprising: a discharge port 33 as a discharge outlet for discharging a first liquid such as a transparent solvent 35; a quantifying part outlet 32 as an outlet for outputting a second liquid such as an ink 34; a piezoelectric element 6 as a discharge means for discharging the transparent solvent 35 from the discharge port 33; and a quantifying part 2 as a quantifying means for measuring and quantifying the ink 34 with a quantifying part liquid chamber 8 which is a liquid chamber for being filled with the ink 34, wherein: the quantifying part 2 changes the volume of the quantifying part liquid chamber 8 to quantify and measure an amount of the ink 34; the discharge port 33 and the quantifying part outlet 32 are arranged to forming a predetermined angle; and the first liquid and the second liquid are mixed at the outside of the discharge port 33 and the outlet 32 of the quantifying part.

In the ink jet printer head, the discharge means can be composed of a piezo element.

Furthermore, in the ink jet printer head, the discharge means can be composed of a heating element.

Furthermore, in the ink jet printer head, the predetermined angle is about 90°.

Furthermore, in the ink jet printer head, the quantifying part 2 has a piston 12 that can move up and down inside the quantifying part of liquid chamber 8, and the ink 34 can be quantified by moving the piston 12 in one direction.

Moreover, the foregoing objects and other objects of the invention have been achieved by the provision of an ink jet printer, comprising: a head 58 as the ink jet printer head described above for printing on a matter to be printed such as printing paper 53; a right-end sensor 57 as a detection means for detecting the completion of one line printing on the printing paper 53 by the head 58; and a CPU 61 as a control means for controlling the piston 12 of the quantifying part 2 provided in the head 58 to return to the original position when the completion of one line printing on the printing paper 53 is detected by the right-end sensor 57.

The nature, the principle and utility of the invention will become more apparent from the following detailed description when read in conjunction with the accompanying drawings in which like parts are designated by like reference numerals or characters.

DETAILED DESCRIPTION OF THE EMBODIMENT

Figure 1:
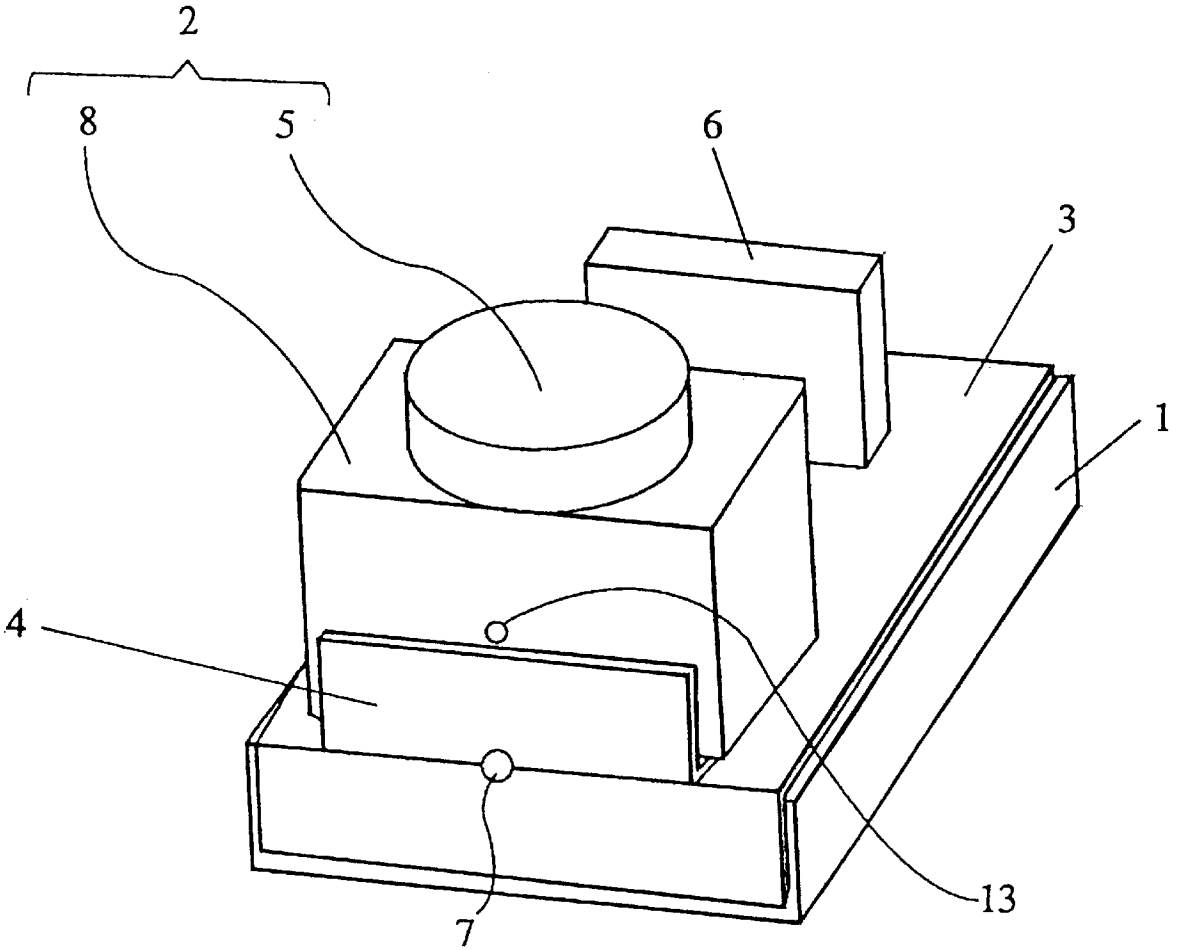
FIG. 1 is a perspective view showing the construction of the ink jet printer head according to one embodiment of the present invention.
Figure 2A:
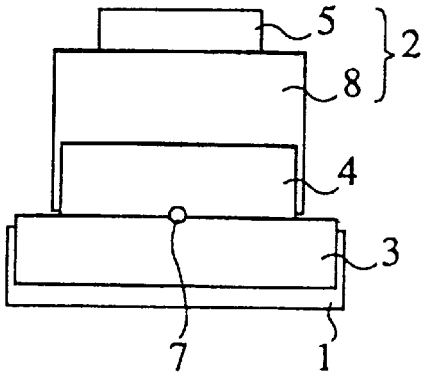
FIGS. 2A to 2C are a front view, a side view and a plane view of the embodiment of FIG. 1.
Figure 2B:
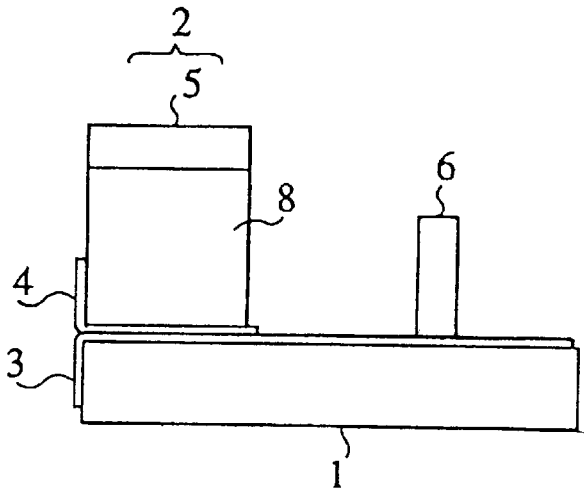
Figure 2C:
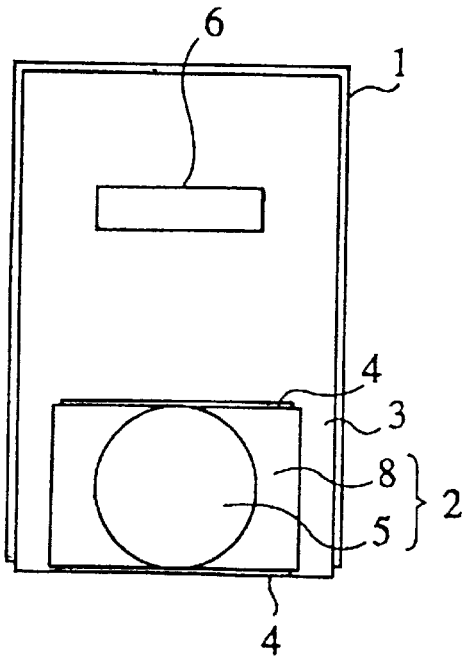
Figure 3A:
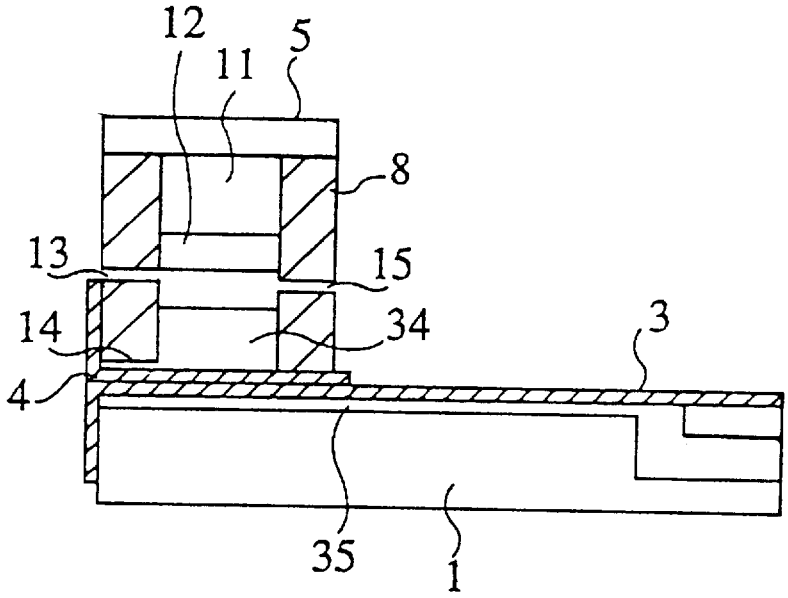
FIGS. 3A and 3B are cross sectional views showing the embodiment of FIG. 1.
Figure 3B:
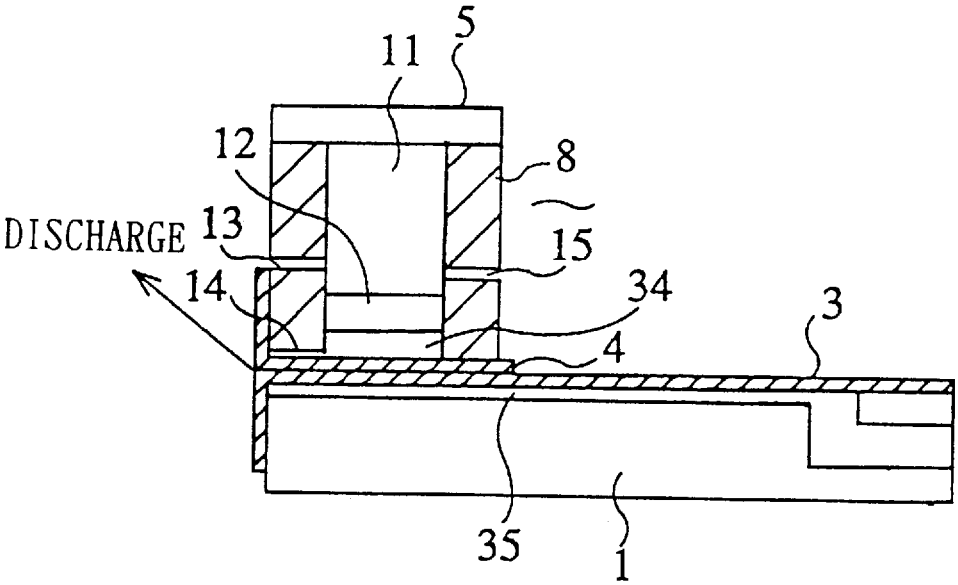

Preferred embodiments of this invention will be described with reference to the accompanying drawings:

FIG. 1 is a perspective view showing the construction of one embodiment of the ink jet printer head according to the present invention. FIGS. 2A to 2C are a front view, a side view, and a plan view, respectively. Furthermore, FIGS. 3A and 3B show cross sectional views of the embodiment of FIG. 1. Incidentally, in FIGS. 3A and 3B, a piezoelectric element 6 as shown in FIGS. 1, 2A and 2B is omitted.

Figure 4C:
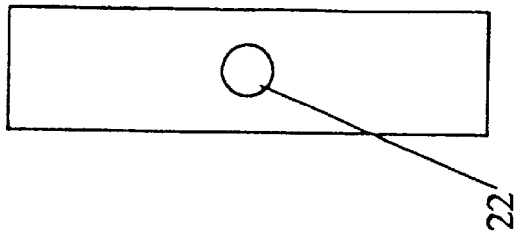
FIGS. 4A to 4D are views showing more a detailed construction of the base 1 in the embodiment of FIG. 1.
Figure 4A:
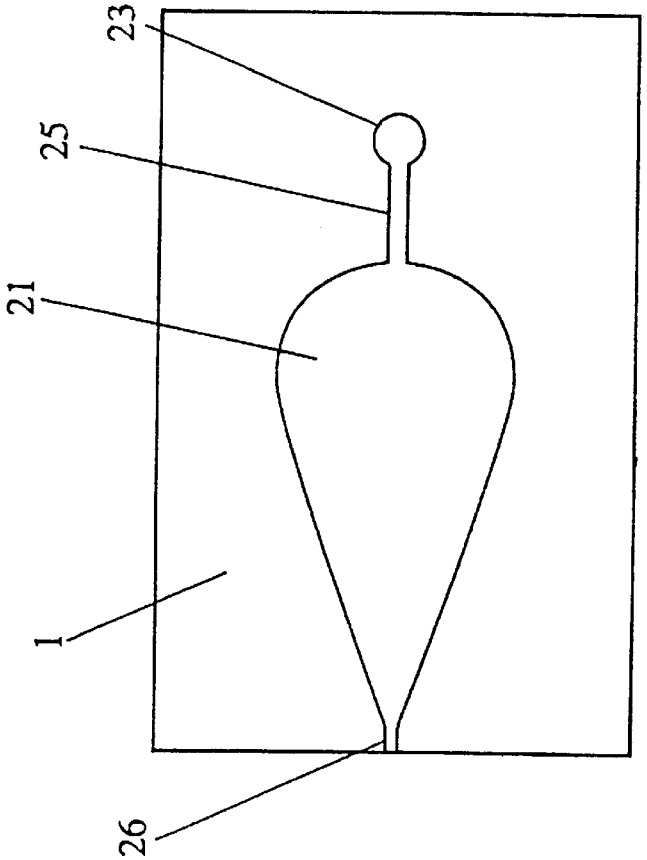

A base 1 is composed of stainless steel, for example, SUS303, having a rectangular configuration as shown in FIG. 4A. Incidentally, FIGS. 4A to 4D are a plane view, a left side view, a right side view, and a sectional view, respectively.

Figure 4D:
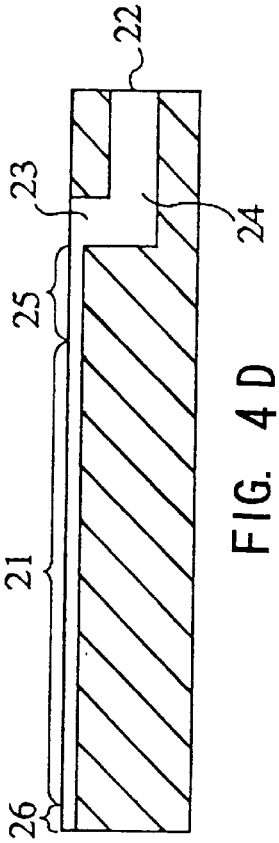
Figure 4B:
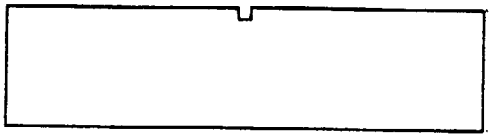

On the upper surface of the base 1, a base liquid chamber 21 is formed as a hollow having a depth of 100 $\mu$m, as shown in FIG. 4A. On the front surface of the base liquid chamber 21 (on the left side in FIG. 4A), a nozzle 26 having the same depth as the depth of the base liquid chamber 21 is formed on the front surface of the base 1 (FIG. 4B).

On the other hand, on the back (on the right side in FIG. 4A) of the base liquid chamber 21, a tube-like capillary 25 is formed which communicates to the base liquid chamber 21. The depth of the capillary 25 is rendered equal to the depth of the base liquid chamber 21.

The other end of the capillary 25, which does not communicate to the base liquid chamber 21, communicates to a liquid supply channel outlet 23. The liquid supply channel outlet 23 communicates to the liquid supply channel inlet 22 (FIG. 4C) formed on the rear side of the base 1 via an L-shaped liquid supply channel 24 (FIG. 4D).

A transparent solvent tank (not shown) communicates to the liquid supply channel inlet 22 from which a transparent solvent 35 (FIGS. 3A and 3B) composed of clean water, alcohol or other solvents such as chlorooctane is supplied via a solvent resistance tube (not shown). The transparent solvent 35 reaches the capillary 25 via the liquid supply channel 24 and the liquid supply channel outlet 23, and is guided to the base liquid chamber 21 by capillary phenomenon.

Therefore, the base liquid chamber 21 is filled with the transparent solvent 35.

Referring to FIGS. 1, 3A and 3B, on the upper surface of the base 1 (on which the base liquid chamber 21 (shown in FIGS. 4A to 4C is formed) and on the front surface (on the end surface side of the nozzle 26 (FIGS. 4A and 4D)), a bent orifice plate 3 of the discharging part is fixed so that the orifice plate 3 covers the upper surface and the front surface and the positions of the orifice (hole) and the nozzle 26 of the base 1 are matched with each other.

Figure 5:
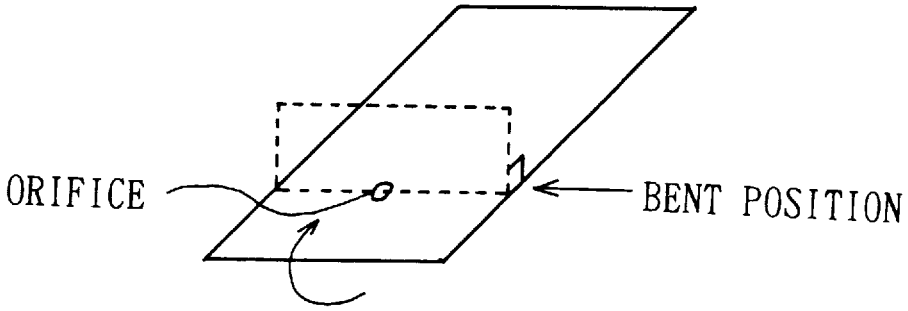
FIG. 5 is a view explaining a method for manufacturing orifice plates 3 and 4.

Here, the orifice plate 3 (the bent orifice plate 4 of the quantifying part described later is the same), as shown in FIG. 5, has an orifice (hole) with 10 to 100 $\mu$m$\phi$ in diameter (in this embodiment, 87.5 $\mu$m$\phi$ in diameter) formed by, for example, the electro-forming method. Further, the orifice plate 3 is composed of, for example, nickel having a thickness of 10 to 200 $\mu$m (20 $\mu$m in this embodiment), and is bent at an angle of 90° as shown by the broken line at the orifice position (position in the center of the hole).

In addition, the orifice plate 3 is stuck (fixed) to the base 1 by coating or blowing an adhesive to a portion corresponding to a portion other than the hollow portion where the transparent solvent 35 in the base liquid chamber (FIGS. 4A and 4D) passes through out of the surface facing to the base 1, and pressing or heat-pressing to the base 1. The adhesive which is a mixture of a solvent-resistance adhesive being not affected by the transparent solvent 35 and the ink 34 (for example, dye such as C.I. Basic Red 46, glycerol, diethylene glycol, and water are mixed with the ratio of 2:2:6:30 wt %, respectively) and a room temperature setting agent (Hardener HV953U and the like) are mixed for the same amount (hardened completely at 25° C. for 12 hours or more)). The solvent-resistance adhesive is, for example, a mixed one or two-liquid epoxy adhesive such as CIBA-GEIGY'S epoxy resin adhesive (Arakdite AW106, and the like).

Furthermore, the orifice plate 3 is improved in the surface properties to improve the stream (cut) of the transparent solvent 35.

On the upper portion of the orifice plate 3 corresponding to the base liquid chamber 21 (FIGS. 4A and 4D) formed on the base 1, a piezoelectric element 6 such as a single-plate or laminated piezo element, a unimorph, or a bimorph is fixed. Furthermore, the surface of the piezoelectric element 6 opposite to the side fixed to the orifice plate 3 is fixed to the housing (not shown). Then, the piezoelectric element 6 is being distorted to elongate in the vertical direction when a voltage is applied to the electrode (not shown). However, as the upper side is fixed to the housing as described above, the piezoelectric element 6 is distorted (elongated) to the lower direction (direction of the orifice plate 3), so that the transparent solvent 35 supplied in the base liquid chamber 21 of the base 1 (FIGS. 4A and 4D) is pressed instantly.

Consequently, the orifice plate 3 is operated not only as an orifice plate, but as an oscillation plate.

Figure 6:
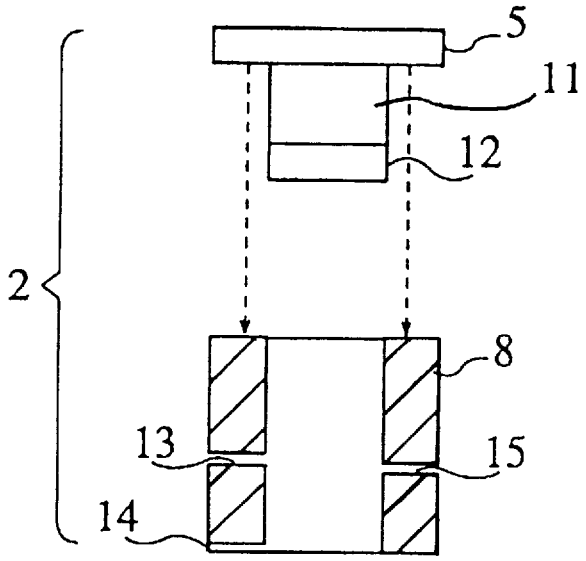
FIG. 6 is a view showing more detailed construction of the quantifying part 2 in the embodiment of FIG. 1.

On the upper part of the orifice plate 3, a quantifying part 2 is provided via a bent orifice plate 4 of the quantifying part. As shown in FIG. 6, the quantifying part 2 is composed of a piezo element support 5, a quantifying part liquid chamber 8, a piezo element 11, and a piston 12.

The quantifying part liquid chamber 8 is formed of a rectangular-shaped stainless steel in the same manner as the base 1. From the upper surface to the lower surface (between the bottom surface), a cylindrical-shaped hollow hole is formed. In the middle stage of the front surface (on the side of the discharge port 7 (FIG. 1)), a tube-like air deflation channel 13 for communicating between the outside and the inside is formed. Moreover, a tube-like liquid flow channel 14 communicating between the outside and the inside is formed on the lowest stage of the same surface.

In addition, on the surface opposite to the surface on which the air deflation channel 13 and the liquid flow channel 14 are formed, a liquid supply channel 15 which communicate the outside and the inside is formed at a position a little lower than a position where the air deflation channel 13 is formed. The ink 34 is supplied from an ink tank (not shown) to the liquid supply channel 15.

The piston 12 has a cylindrical shape having approximately the same bottom surface as the bottom surface of cylindrical-shaped hollow of the quantifying part liquid chamber 8. The piston 12 is sufficiently lower than the quantifying part liquid chamber 8. Incidentally, the piston 12 is constituted in such a manner that the side thereof can move through the cylindrical-shaped hollow of the quantifying part liquid chamber 8 with the predetermined frictional force.

The material of the piston 12 is not limited to any particular type. Such materials as rubber which absorbs the pressure cannot accurately change the volume of the quantifying part liquid chamber 8 with ease as described later. Therefore, a hard substance such as stainless steel is desirable.

On the upper surface of the piston 12, the piezoelectric element 11 having a predetermined height and approximately the same configuration of the bottom surface as the bottom surface of the piston 12 is fixed by bonding or the like. On the surface of the piezoelectric element 11, opposite to the surface on which the piston 12 is fixed, the piezo element support 5 is fixed.

The piezo element support 5 has a disc-shaped configuration (FIG. 2C) having the bottom with approximately the same length in diameter as the short side of the bottom of the quantifying part liquid chamber 8. As shown by the broken line in FIG. 6, the piezo element support 5 is fixed by bonding on the upper surface of the quantifying part liquid chamber 8.

Incidentally, regarding the dimension of each part of the quantifying part 2, when the piezo element support 5 and the quantifying part liquid chamber 8 are fixed by bonding, as shown in FIG. 3A, the air deflation channel 13 and the liquid supply channel 15 are arranged not to be sealed by the piezoelectric element 11 or the piston 12.

In the quantifying part 2, in the case of the state shown in FIG. 3A (a voltage is not applied to the electrode of the piezoelectric element 11), the ink 34 is introduced via a liquid supply channel 15 from the ink tank, and the lower part than the liquid supply channel 15 of the quantifying part liquid chamber 8 is filled with the predetermined amount of the ink 34. Incidentally, air in the quantifying part liquid chamber 8 is discharged from the air deflation channel 13.

On the other hand, the piezoelectric element 11 is composed of, for example, a single-plate or a laminated piezo element, a unimorph, or a bimorph, similarly to the piezoelectric element 6 (FIG. 1) described above. When a voltage is applied to the electrode, the piezoelectric element 11 is distorted to elongate in the height direction. However, the upper side of the element 3 is fixed to the piezo element support 5, so that the piezoelectric element 11 is distorted (elongated) in the lower direction. Thus, the volume of the quantifying part liquid chamber 8 is decreased. Then, the ink 34 having the amount corresponding to the reduced volume, namely the measured quantity ink 34, i.e. the quantified ink 34, is discharged from the liquid flow channel 14.

Referring to FIGS. 1, 3A and 3B, on the lower surface and the front surface (on which the air deflation channel 13 is opened) of the quantifying part liquid chamber 8, a bent orifice plate 4 of the quantifying part is fixed so that the lower surface of the quantifying part liquid chamber 8 is approximately covered and the position of the orifice (hole) and the liquid flow channel 14 of the quantifying part liquid chamber 8 are matched with each other.

The orifice plate 4 is the same as the aforementioned orifice plate 3. In the same manner as the case of fixing the orifice plate 3 and the base 1, the orifice plate 4 is fixed to the quantifying part liquid chamber 8.

Incidentally, the part of the orifice plate 4 which covers the front surface side of the quantifying part liquid chamber 8 is constituted not to seal the air deflation channel 13 (FIG. 1).

The orifice of the orifice plate 4 and the orifice of the orifice plate 3 are fixed to the orifice plate 3 to form one circular discharging part 7 as shown in FIG. 1.

Figure 7A:
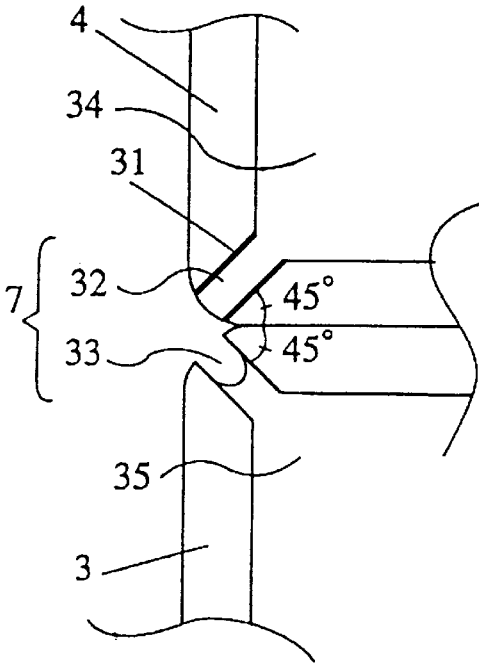
FIGS. 7A to 7D are views explaining the operation of the embodiment of FIG. 1.

The orifice plates 3 and 4 are bent by about 90° at the center of the orifice as shown in FIG. 5. As shown in FIGS. 7A to 7D illustrating an expanded cross sectional views of a portion in the vicinity of the discharging part 7, each orifice (the orifices of the orifice plates 3 and 4 is defined as the port 33 of the discharging part or as the outlet 32 of the quantifying part) forms an angle of 45° with respect to the orifice plates 3 or 4 both fixed to the upper surface of the base 1 or the lower surface of the quantifying part liquid chamber 8 (FIG. 7A).

Consequently, the orifice plates 3 or 4 are arranged to confront respective ends with each other in such a manner that respective orifice (hereinafter referred to as "the port 33 of the discharging part" or "the outlet 32 of the quantifying part") forms an angle of 90°.

Next, the operation of the ink jet printer is explained hereinbelow. First, in the quantifying part 2, the ink 34 is introduced via the liquid supply channel 15 from the ink tank in the state shown in FIG. 3A (in which no voltage is applied to the electrode of the piezoelectric element 11), and the part of the quantifying part liquid chamber 8 lower than the liquid supply channel 15 is filled with a predetermined amount of the ink 34.

Then, a predetermined voltage is applied to the piezoelectric element 11. The piezoelectric element 11 is distorted (elongated) to the lower part, therefore the ink 34 is introduced to the outlet 32 of the quantifying part of the orifice plate 4 via the liquid flow channel 14. As shown in FIG. 7A, the piston 12 is moved (lowered) to the liquid surface of the ink 34 until the surface tension forms the meniscus at the end surface of the orifice plate 4 (the state is referred to as "the stand-by state").

On the other hand, the transparent solvent 35 (FIGS. 3A and 3B) is supplied from the transparent solvent tank to the supply channel inlet 22 of the base 1 (FIG. 4C), and then is introduced to the base liquid chamber 21 via liquid supply channel 24 and the capillary 25.

Then, the transparent solvent 35 fills the base liquid chamber 21, and further reaches the port 33 of the discharging part of the orifice plate 3 via the nozzle 26.

Here, in this state, as shown in FIG. 7A, the ink 34 and the transparent solvent 35 do not come into contact with each other with the, so that the two liquids are not mixed spontaneously.

Thereafter, a voltage which corresponds to the desired density is applied to the piezoelectric element 11 of the quantifying part 2 (FIGS. 3A and 3B): The voltage corresponding to the desired density is to the aforementioned voltage added. Then, the piezoelectric element 11 is distorted (elongated) downward in correspondence to the applied voltage, as shown in FIG. 3B, therefore the piston 12 fixed to the piezoelectric element 11 also moves downward inside the quantifying part liquid chamber 8.

Figure 7B:
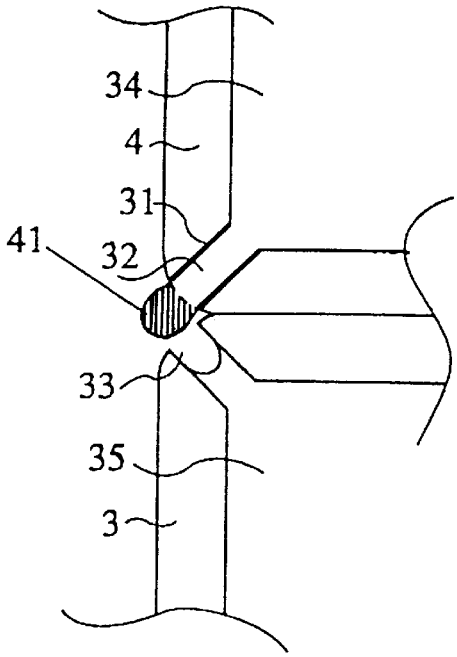

Thereby, the volume of the quantifying part liquid chamber 8 is reduced, and the ink 34, is measured and quantified to a desired amount by the reduced amount of volume of the chamber 8, specifically,the ink 34 is quantified corresponding to the desired density, and is introduced to the outlet 32 of the quantifying part of the orifice plate 4 via the liquid flow channel 14. As shown in FIG. 7B, a quantified liquid 41 (a portion shown by adding a slanted line in FIG. 7B) is formed in front of the end surface of the port 33 of the discharging part forming an angle of about 90° with the outlet of the quantifying part 32 so that the quantified liquid oozes out from the end surface of the outlet 33 of the quantifying part.

On the other hand, a pulse voltage (voltage pulse) is applied to the piezoelectric element 6 (FIG. 1). Incidentally, the voltage pulse applied to the piezoelectric element 6 is a voltage pulse having a specific voltage and a specific pulse width.

Then, the piezoelectric element 6 is distorted (elongated) toward the side of the orifice plate 3 as described above, so that the orifice plate 3 is bent toward the side of the base liquid chamber 21 (FIGS. 4A and 4D) of the base 1. Therefore, the volume of the base liquid chamber 21 is reduced and internal pressure is generated. With this pressure, the transparent solvent 35 is discharged from the port 33 of the discharging part of the orifice plate 3.

Figure 7C:
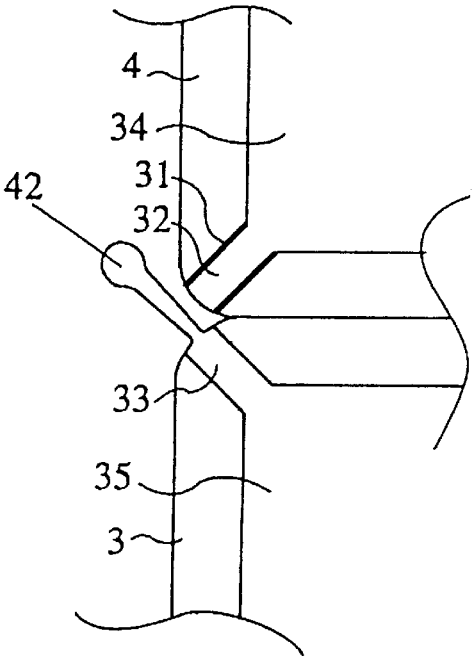
Figure 7D:
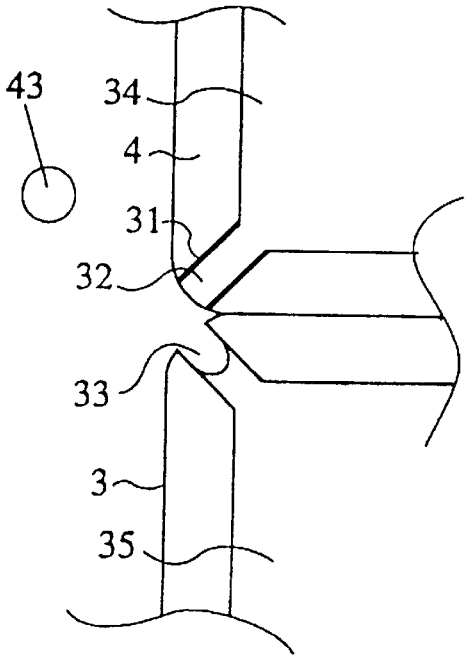

Growing in a cylindrical-shaped configuration, the discharged transparent solvent 35, as shown in FIG. 7C, collides with the quantified liquid 41 oozing out from the outlet 32 of the quantifying part formed in front of the discharge direction. And then the quantified liquid 41 is integrated and mixed while being separated at the end surface of the outlet of the quantifying part 32 to produce a mixed liquid 42 having a desired density.

Thereafter, when the voltage pulse is turned off (the voltage becomes 0 V) with respect to the piezoelectric element 6 (FIG. 1), the piezoelectric element 6 returns to the original configuration. Since, along with it, the base liquid chamber 21 of the base 1 (FIGS. 4A and 4D) is returning to the original configuration, the internal pressure is reduced. Therefore, the transparent solvent 35 from the transparent solvent tank is drawn into the base liquid chamber 21 via liquid supply channel 24 and capillary 25. The cylindrical-shaped transparent solvent 35 projecting from the port 33 of the discharging part is separated, in which the tip is the mixed liquid 42 (FIG. 7C).

Then, the mixed liquid 42 (FIG. 7C) formed with the separated transparent solvent 35 and the quantified liquid 41 (FIG. 7B) becomes a mixed discharge liquid 43 (FIG. 7D) having a desired density, which is discharged with the discharging power of the transparent solvent 35 and stuck to the printing paper.

Incidentally, the discharge direction of the mixed discharge liquid 43 is the direction in which the transparent solvent 35 is discharged from the port 33 of the discharging part, more specifically, the direction forming an angle of about 45° in the upward direction with respect to the surfaces of the orifice plates 3 or 4 respectively fixed to the upper surface of the base 1 or the lower surface of the quantifying part liquid chamber 8.

At the port 33 of the discharging part, the transparent solvent 35 is filled again up to the end surface of the port 33 (FIG. 7A) by capillary phenomenon. In addition, the ink 34 in which quantified liquid 41 (FIG. 7B) is separated at the end surface of the outlet 32 of the quantifying part forms the meniscus again with surface tension (FIG. 7A).

In the same manner, the voltage corresponding to the dot density to be printed is further applied to the piezoelectric element 11 of the quantifying part 2 (FIGS. 3A and 3B) herein below. At the same time, in synchronization with the timing, rich gradation printing is performed by giving a voltage pulse to the piezoelectric element 6 (FIG. 1).

Figure 8C:
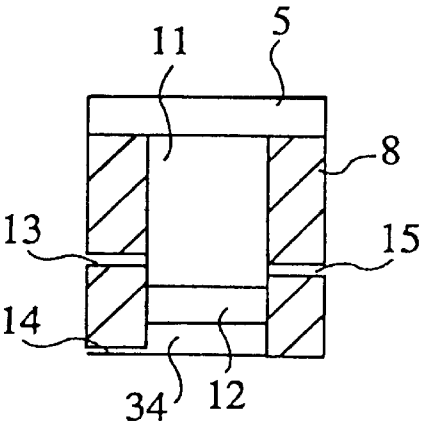
FIGS. 8A to 8C are views explaining the operation of the piston 12 in the quantifying part 2 in the embodiment of FIG. 1.
Figure 8B:
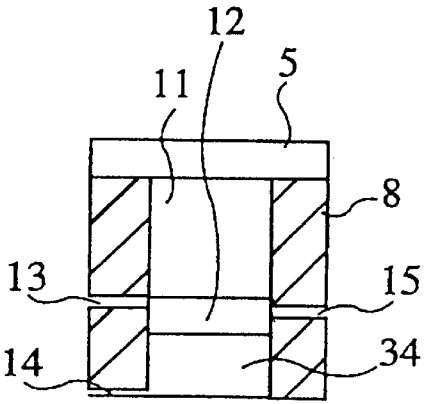
Figure 8A:
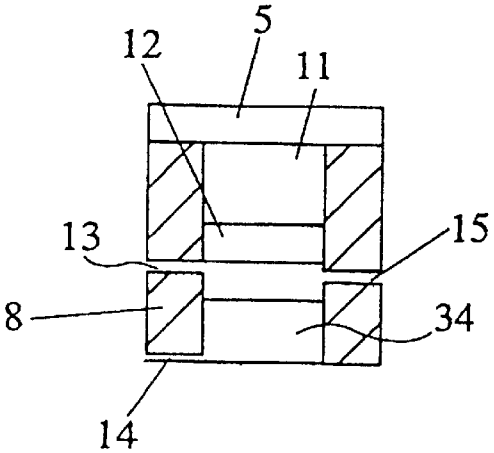

Here, a further detailed description is following on the operation of the quantifying part 2 referring to FIGS. 8A to 8C. At first, in the quantifying part 2, when no voltage is applied to the electrode of the piezoelectric element 11, namely when the piezoelectric element 11 is not distorted, the ink 34 is introduced from the ink tank via the liquid supply channel 15. Then, part of the quantifying part liquid chamber 8 lower than the liquid supply channel 15 is filled with a predetermined amount of the ink 34 (FIG. 8A).

Then, a predetermined voltage is applied to the piezoelectric element 11, so that the piezoelectric element 11 is distorted (elongated) downward to be placed in a stand-by state (FIG. 8B).

Thereafter, as described above, the voltage corresponding to the dot density to be printed is piled up to apply to the piezoelectric element 11, so that the piezoelectric element 11 distorts gradually downward. The piston 12 is moved to downward, thereby the volume of the quantifying part liquid chamber 8 is reduced to quantify the ink 34.

Then, when the voltage applied to the piezoelectric element 11 reaches a predetermined value and the amount of distortion (amount of elongation) of the piezoelectric element 11 reaches a predetermined value, that is, the reduction amount in volume of the quantifying part liquid chamber 8 reaches a predetermined value (FIG. 8C), the voltage application to the piezoelectric element 11 is terminated (the application voltage is set to 0 V).

Therefore, the piezoelectric element 11 returns to the original state, so that the volume of the liquid supply chamber 8 also returns to the original state. Then, the ink 34 is supplied via the liquid supply channel 15, and the lower part of the quantifying part liquid chamber 8 than the liquid supply channel 15 is filled with a predetermined amount of the ink 34 (FIG. 8A).

In this manner, in this ink jet printer head, the ink 34 and the transparent solvent 35 are mixed at the outside of the outlet 32 of the quantifying part and the end surface of the port 33 of the discharging part, so that the mixed liquid does not remain inside of the head. As a result, accurate printing can be performed.

Furthermore, in the quantifying part liquid chamber 8, the piezoelectric element 11 moves the piston 12 in the downward direction to reduce the volume of the liquid chamber 8, and the ink 34 in the same amount as the reduced amount of volume of the liquid chamber 8 is forced to be pushed out from the outlet 32 of the quantifying part, thereby the reverse current (return) of the quantified amount of the ink 34 is prevented. Thus, accurate quantifying can be performed.

As a result, expression capabilities in the highlight portion increases, thereby rich gradation printing can be performed.

Figure 9:
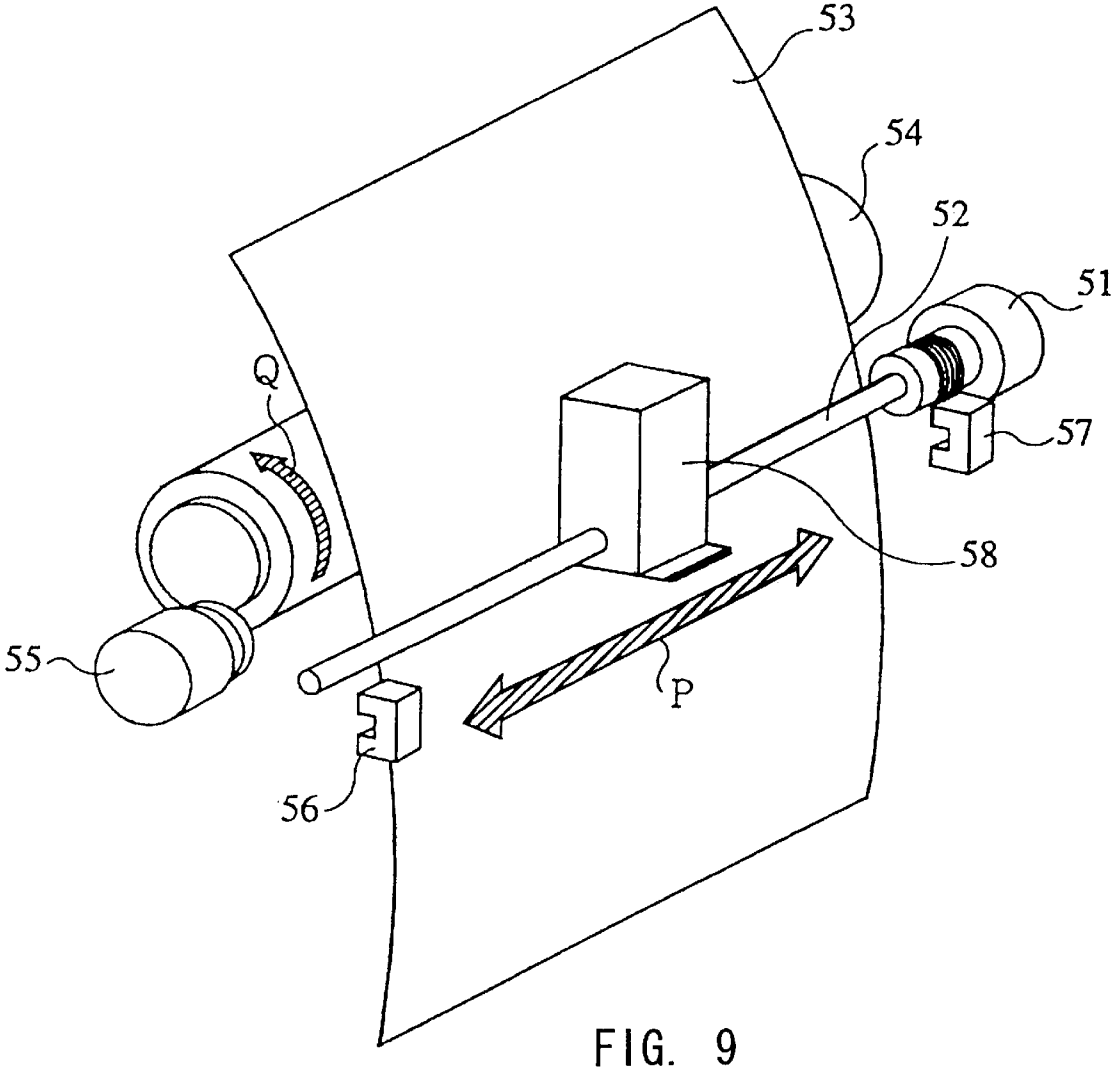
FIG. 9 is a view showing the construction of the ink jet printer according to one embodiment of the present invention.

Next, FIG. 9 shows the construction of one embodiment of the ink jet printer of the present invention. This ink jet printer is a serial type in which a printing paper 53 as the material to be printed is partially wound around a drum 54, and is held by being pressed to the drum 54 by a paper pressing roller (not shown) provided in parallel in the axial direction.

On the periphery of the drum 54, a feed screw 52 is provided in parallel with the axial direction of the drum 54. A head 58, which is the ink jet printer head shown in the aforementioned FIG. 1, is engaged with the feed screw 52. Then, the feed screw 52 is rotary driven by the head feeding motor 51, and thereby the head 58 can be moved in the axial direction (designated by arrow P). In addition, the drum 54 is rotary driven by a paper feed motor 55.

Furthermore, either on the left-end or the right-end of the feed screw 52, either a left-end sensor 56 or a right-end sensor 57 is provided for detecting that the head 58 has moved either to the left most end or to the right most end within the scope in which printing can be performed with respect to the printing paper 53.

In the ink jet printer constructed in the aforementioned manner, every time one line of printing is completed, the application of the voltage to the piezoelectric element 11 (FIGS. 8A to 8C) of the quantifying part 2 which constitutes the head 58 is terminated and supply of the ink 34 is started.

More specifically, the feed screw 52 moves the head 58 to the position of the left-end sensor 56. Then, the head 58 is moved by one pitch in the direction of the right-end sensor 57. Then, as described in FIGS. 7A to 7D, the mixed discharge liquid 43 is discharged from the head 58 synchronizing with the movement of the head 58 to form an image on the printing paper 53.

When the head 58 is moved to the position of the right-end sensor 57 and one line of printing is completed, the paper feed motor 51 rotates the drum 54 by one line in the direction designated by arrow Q in FIG. 9, and simultaneously, the head 58 is moved to the position of the left-end sensor 56. During this time, the aforementioned ink 34 (FIG. 8A) is supplied. Then, in the same manner, the next line is printed.

Incidentally, printing can be performed not only when the head 58 moves from the left to right described above, but also when moving from the right to left. In this case, the ink 34 (FIG. 8A) is supplied as described above while the drum 54 rotates for one line.

Figure 10:
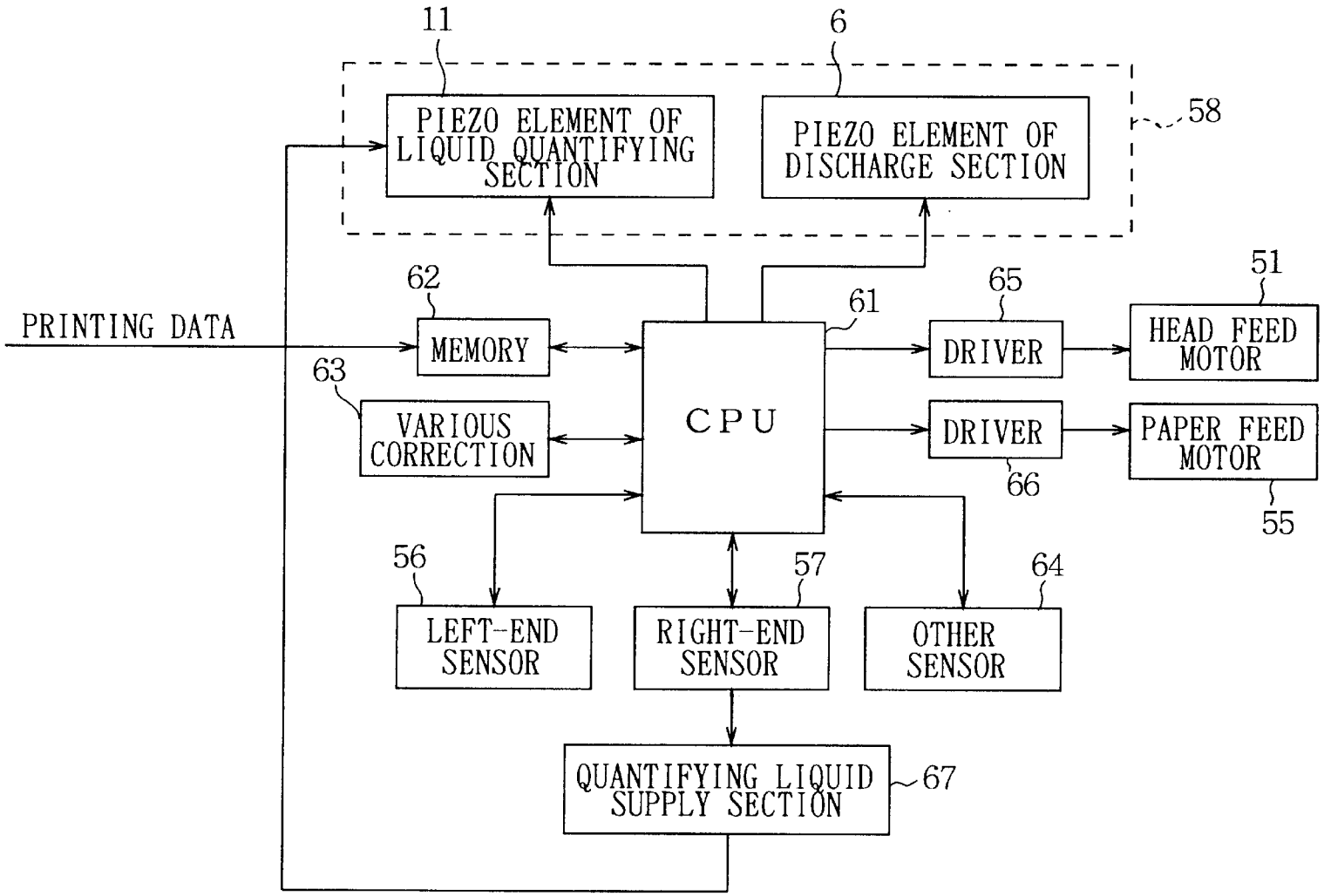
FIG. 10 is a block diagram showing the electrical construction according to the embodiment of FIG. 9.

Next, FIG. 10 is a block diagram showing the electrical construction of the ink jet printer shown in FIG. 9. Printing data and a signal such as a control signal for printing (hereinafter referred to as "printing data") are entered in a memory 62 and temporarily stored. In the memory 62, memorized printing data is put in order of print and read in accordance with the control of a CPU 61, and then outputted to the CPU 61.

The CPU 61 outputs a control signal to drivers 65 and 66 based on printing data from memory 62, outputs from other sensors 64, for example detecting paper empty, from the left-end sensor 56, from right-end sensor 57, and so on. The drivers 65 and 66 respectively rotate a head feed motor 51 and a paper feed motor 55 in correspondence to the control signal from the CPU 61. Thus, as shown in FIG. 9, a head 58 is moved or the drum 54 is rotated.

Furthermore, the CPU 61 applies voltage pulse and voltage to the electrode of the piezo elements 6 or 11 of the head 58 based on the printing data. More specifically, as shown in FIG. 11A, in the CPU 61, while the head 58 moves from the left-end sensor 56 (FIG. 9) to the right-end sensor 57 (hereinafter referred to as "head feed time"), a voltage pulse having a definite width is applied to the piezoelectric element 6 at a definite voltage E with the timing at which printing is performed on the printing paper 53.

Figures 11A, 11B:
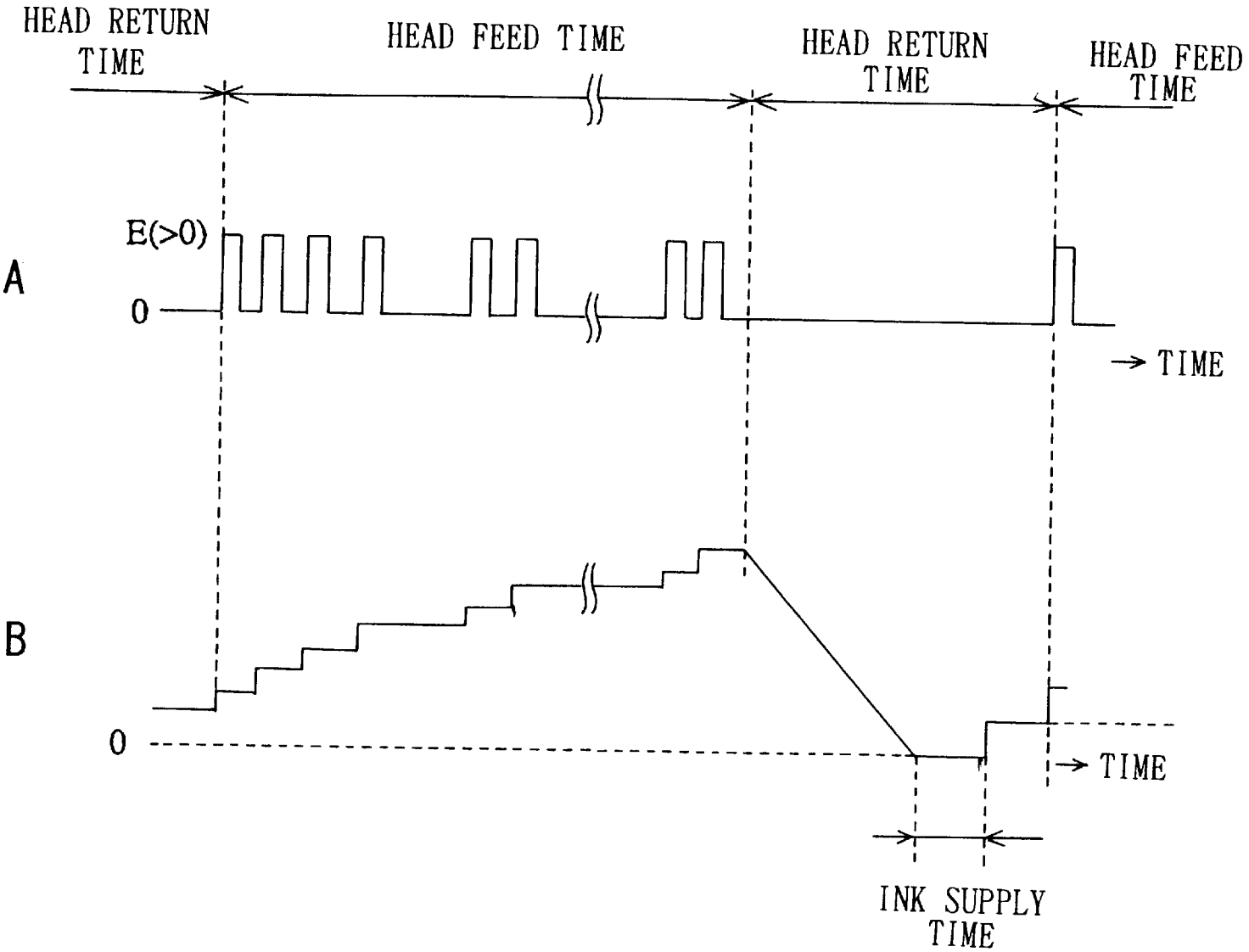
FIGS. 11A and 11B are waveform diagrams showing voltage applied to the piezoelectric elements 6 and 11 in the embodiment of FIG. 10.
Figure 12C:
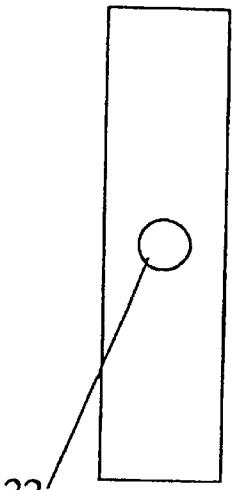
FIGS. 12A to 12D are views showing the construction of another embodiment of the base 1.
Figure 12A:
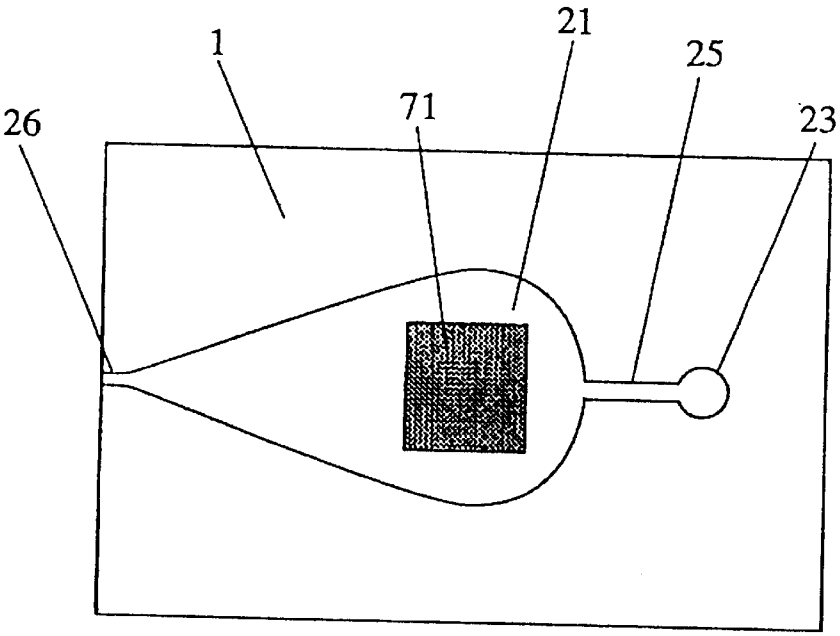
Figure 12D:
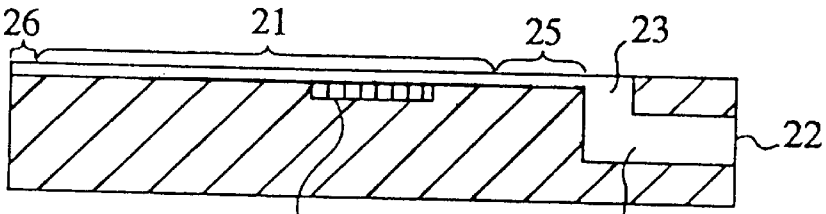
Figure 12B:
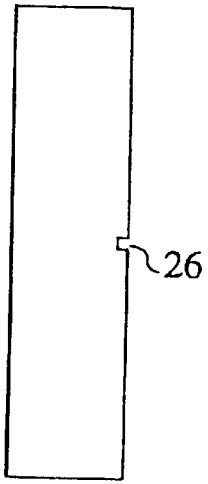

Furthermore, during the head feed time, as shown in FIG. 11B, the CPU 61 piles up the voltage immediately before the former voltage and applies a voltage corresponding to the dot density to the piezoelectric element 11 synchronizing with the timing at which a voltage pulse is applied to the piezoelectric element 6. Therefore, quantification of the ink 34 and discharge of the transparent solvent 35 are performed as shown in FIGS. 7A to 7D, so that the desired density of the mixed discharge liquid 43 (FIG. 7D) is stuck by discharging on the printing paper 53.

Then, when the head 58 is moved to the most right-end of the printable area, that is, the end position of one line of the printing paper 53, the right-end sensor 57 detects the head 58 to output the detection signal to the CPU 61 and a quantified liquid supply part 67.

When the CPU 61 receives the detection signal from the right-end sensor 57, the control signal is outputted to the drivers 65 and 66, which move the head 58 to the side of the left-end sensor 56, and rotate the drum 54 for one line.

Furthermore, the CPU 61 terminates the application of the voltage pulse to the piezoelectric element 6 while the head 58 moves (returns) from the position of the right-end sensor 57 to the position of the left-end sensor 56 (hereafter referred to as "head return time") (FIG. 11A). At the same time, the voltage applied to the piezoelectric element 11 is rendered 0 V (FIG. 11B). Therefore, the piezoelectric element 11 returns from the state shown in FIG. 8C to the state shown in FIG. 8A, and the volume of the quantifying part liquid chamber 8 also returns to the original state.

On the other hand, when the quantified liquid supply part 67 receives the detection signal from the right-end sensor 57 and then the voltage applied to the piezoelectric element 11 is rendered 0 V, the ink tank is controlled to supply the ink 34 to the quantifying part liquid chamber 8 via the liquid supply channel 15 (FIG. 8A).

Then, when the quantifying part liquid chamber 8 is filled with the predetermined amount of ink 34 during the predetermined ink supply time (FIG. 11B), the CPU 61 applies a predetermined voltage to the piezoelectric element 11. Thereby, the piezoelectric element 11 is distorted (elongated) downward to provide a stand-by state (FIG. 8B).

Thereafter, when the head 58 is moved to the left most end of the printable area, that is, to the initial position of the one line on the printing paper 53, the left-end sensor 56 detects the head 58 to output the detection signal to the CPU 61.

When the CPU 61 receives the detection signal from the left-end sensor 56, the CPU 61 resumes the reading of the printing data from memory 62 again. Then, the aforementioned processing is repeated to print on the printing paper 53.

In the case of the multiple head having a large number of nozzles, an IC is installed in the head 58 to reduce the number of wirings connected to the head 58. Further, each type of correction circuit 63 is connected to the CPU 61 to perform γ-correction, color correction in the case of color printing, and scattering correction of the head 58. In each type of correction circuit 63, predetermined correction data is stored in the ROM mapping method so that such correction data can be fetched corresponding to the external conditions such as the number of nozzles, the temperature, and input signals.

Next, a description is given on the dimension of each part of the quantifying part 2 (FIGS. 8A to 8C) when the ink 34 is supplied for each line.

At first, when the head 58 is a serial head having a density of, for example, 4 dot/mm, the minimum printing dot diameter which can form a solid black is about 250 μmφ. It is often said that the printing dot diameter is about one to three times the discharge dot diameter of the port 33 of the discharging part. Assuming that the printing dot diameter is about two times the discharge dot diameter of the port 33 of the discharging part, the discharge diameter need to be set, for example, to 120 $\mu$mϕ.

When the discharge dot diameter is set to 120 $\mu$mϕ, the volume per dot of the transparent solvent 35 discharged from the outlet of the discharge port 33 is set approximately to $9.05\times10^5$ $\mu m^3$ ($\approx 4\times\pi\times(60\ \mu m)^3/3$). In this case, when the volume ratio of the transparent solvent 35 and the ink 34 to be mixed together is set to the scope of 10:0 to 10:10 (provided that, the volume ratio of the dischargeable transparent solvent 35 is set to 10:10) and the eight gradation in-dot density gradation representation is performed, the minimum quantified volume of the ink 34 may be set, for example, to ⅛ of one dot of the transparent solvent 35. Consequently, the minimum volume of the ink 34 is set approximately to $5.66\times10^4$ $\mu m^3$ ($\approx 9.05\times10^5\ \mu m^3/2/8$).

On the other hand, when the internal diameter of the quantifying part liquid chamber 8 is set to 2 mmϕ and the maximum quantifying amount of the ink 34 is quantified, the displacement amount of the piston 12 (piezoelectric element 11) is set to approximately 0.144 $\mu$m ($\approx 9.05\times10^5\ \mu m^3/2/(\pi\times(1000\ \mu m)^2)$).

When the size of the printing paper 53 is set to A4 and printing is performed for 200 mm at maximum in one line, the quantification of the ink is performed at least 800 times (=200 mm×4 dot/mm). Consequently, the piston 12 lowers by 115.2 $\mu$m (=0.144 $\mu$m×800 times) at most in one line of printing. Thus, the position of the lower surface of the piston 12 in the stand-by state (FIG. 8B) needs to be located at a position 115.2 $\mu$m or more from the bottom surface of the quantifying part liquid chamber 8.

In addition, for example, when the diameter of the air deflation channel 13 of the quantifying part 2 or the liquid supply channel 15, shown in FIG. 6 (and FIGS. 8A to 8C), is respectively set to 50 $\mu$mϕ, and the height difference in the central position is set to 50 $\mu$m, the height difference of the lower surface of the piston 12 between the supply time of the ink 34 shown in FIG. 8A and the stand-by state shown in FIG. 8B must be 100 $\mu$m (=50 $\mu$m+50 $\mu$m) or more. In this embodiment, the height difference is set to, for example, 200 $\mu$m.

As described above, in the ink jet printer shown in FIGS. 9 and 10, when it is detected by the head 58 that one line of printing for the printing paper 53 is completed, the piston 12 in the quantifying part 2 is brought back to the original position by making use of the return time of the head 58 from the line end (position of the right-end sensor 57) to the line head (position of the left-end sensor 56). Consequently, rich gradation printing can be performed safely at a high speed for each line.

Incidentally, in this embodiment, the transparent solvent and the ink are mixed. However, this invention is not limited to this, but the ink and the non-transparent solvent (ink) can be mixed depending on the result of the desired printing.

Furthermore, in this embodiment, in-dot density gradation is performed in which a predetermined amount of the transparent solvent is mixed with the amount of the ink corresponding to the desired density. However, this invention is not only limited to this, but in-dot density gradation can be performed in which the mixed amount is definite by changing the amount of the transparent solvent corresponding to the ink amount. This can be implemented by changing the voltage pulse (pulse width, voltage) given to the piezoelectric element 6. Moreover, a dither can be used in combination.

In this case, gradation representation capability can be largely improved.

Furthermore, it is desirable to use the material of resistance against the solvent for each part of the ink jet printer head (FIG. 1). However, the material is not particularly limited to any specific type as long as the transparent solvent and the ink are soluble in water.

Furthermore, the ink is not only limited to the one soluble in water which is used in the conventional ink jet printer, but the ink soluble in oil can be used.

Furthermore, the transparent solvent may be soluble either in water or in oil.

Furthermore, as shown in FIGS. 7B and 7C, the ink 34 must be discharged from the outlet 32 of the quantifying part at a timing faster than the transparent solvent 35 is discharged out of the port 33 of the discharging part. The difference in timing is set in consideration of the discharge frequency, that is, the frequency of the voltage pulse applied to the piezoelectric element 6 (for example, on the order of 100 Hz).

Furthermore, voltage application time to the piezo elements 6 and 11 is set respectively based on the volume of the base liquid chamber 21 of the base 1 and the volume of the quantifying part liquid chamber 8 of the quantifying part 2.

Furthermore, at the outlet 32 of the quantifying part, that is, at the inside of the orifice (hole) in the orifice plate 4, as shown in FIGS. 7A to 7D, an edge water treatment film 31 for treating edge water is provided. In this case, the precision of the definite quantity of the ink can be improved.

Furthermore, piezo elements such as the bimorph and laminated piezo described above have a hysteresis. However, as the voltage is applied to pile up the voltage, there is no problem of hysteresis.

Still furthermore, problems such as discharge stability, discharge dot size, and the presence of satellites can be settled by appropriately selecting the voltage (pulse width or voltage value) applied to the piezo elements 6 or 11.

Furthermore, in this embodiment, the drum 54 is used. However, a cylindrical platen or a flat platen also can be used.

Still furthermore, in this embodiment, the piezoelectric element 11 moves the piston 12. However, other drive means such as, for example, motors or the like, can move the piston 12.

Furthermore, in this embodiment, the piston 12 is provided on the lower surface of the piezoelectric element 11. The piston 12 need not be provided. However, if the piston 12 is not provided, it can occur that the surface of the piezoelectric element 11 may be damaged by the ink or the like. Moreover, at least on the bottom portion of the piezoelectric element 11, the configuration must be configured into a cylindrical configuration. Therefore, the piston 12 is preferably provided.

Furthermore, in this embodiment, the port 33 of the discharging part and the outlet 32 of the quantifying part are arranged to confront with each other at their ends (end surface) in order to form the angle of about 90°. However, the present invention is not only limited to this, but the orifice plates 3 and 4 can be constituted to form the angle other than 90°, such as 60° and 120° and the like.

Furthermore, in this embodiment, it is described that the present invention is applied to a serial ink jet printer. However, the present invention is not limited to this, but also can be applied to other types of ink jet printers such as the drum rotary type and the line type.

Furthermore, in this embodiment, the transparent solvent 35 (mixed liquid 42) is discharged by pressure generated by the distortion of the piezoelectric element 6. However, this invention is not only limited to this, but the transparent solvent 35 can be discharged by using the pressure of the bubble which is generated by boiling by a heating element other than the piezoelectric element 6.

More specifically, the piezoelectric element 6 shown in FIG. 1 is not provided and, for example, a heating element 71 can be provided in the lower part of the base liquid chamber 21 of the base 1 as shown in FIGS. 12A to 12D.

In this case, the mixed discharge liquid 43 is discharged as shown in FIGS. 13A to 13E. Incidentally, the output of the quantifying liquid 41 from the outlet 32 of the quantifying part is the same as the case shown in FIGS. 7A to 7D. An explanation thereof is omitted, and only the discharge of the transparent solvent 35 is explained.

Figure 13C:
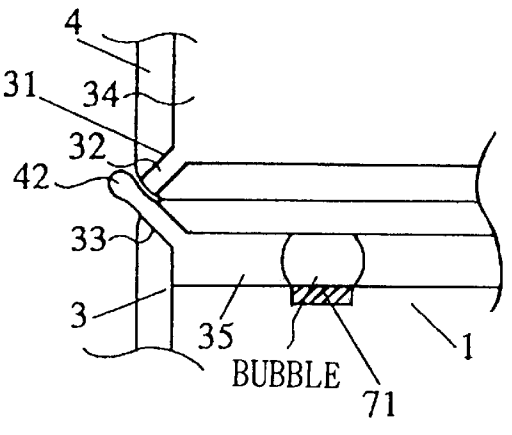
FIGS. 13A to 13E are views explaining the operation of the base 1 of FIGS. 12A to 12D.
Figure 13B:
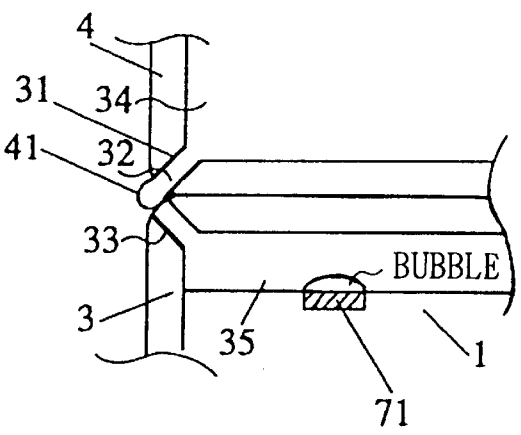
Figure 13A:
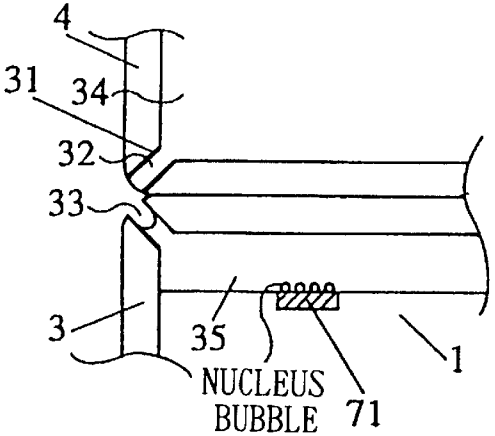

At first, when a predetermined voltage pulse is applied to the heating element 71 for a specific time, some nucleus bubbles are generated on the upper surface of the heating element 71 as shown in FIG. 13A. The nucleus bubbles are integrated to form a bubble as shown in FIG. 13B (a film bubble). Furthermore, this bubble grows by the heat insulating swell to form a large bubble as shown in FIG. 13C.

Then, when the application of the voltage is terminated with respect to the heating element 71, the heat of the bubble is taken away by peripheral transparent solvent 35. Therefore, the bubble shrinks as shown in FIG. 13D, and then the transparent solvent 35 disappears as shown in FIG. 13E.

Figure 13E:
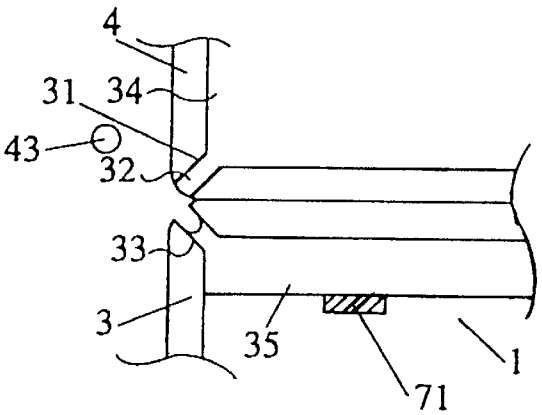
Figure 13D:
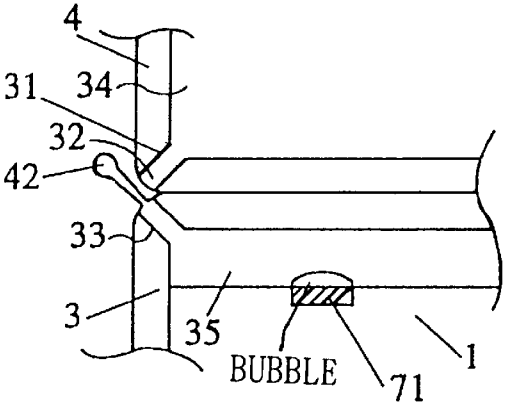

In the process described above, the transparent solvent 35 is discharged from the port 33 of the discharging part by the discharge output power of the film boiling phenomenon generated in the state shown in FIGS. 13C and 13E.

Furthermore, in this embodiment, the position of the air deflation channel 13 is located higher than the liquid supply channel 15 of the quantifying part liquid chamber 8. However, this invention is not only limited to this, but the liquid supply channel 15 can be located higher than the air deflation channel 13. Moreover, the liquid supply channel 15 and the air deflation channel 13 can be located at the same height.

As described above, in accordance with the ink jet printer head of the present invention, the volume of the liquid chamber is changed, so that the quantifying means quantifies the volume of the second liquid to output the second liquid from the outlet and the first liquid is discharged from the discharge port having the end confronting with the end of the outlet of the quantifying part to form a predetermined angle. Therefore, the volume of the second liquid can be quantified accurately. Moreover, since the second liquid and the first liquid are mixed at the outlet or outside of the discharge port, the spontaneous mixing of the second liquid and the first liquid can be prevented.

Furthermore, in accordance with the ink jet printer head of the present invention, the piston vertically moving in the liquid chamber is moved in one direction, so that the second liquid can be quantified by the quantifying means. Consequently, accurate and fine quantification can be performed at a high speed, so that rich gradation printing can be executed at a high speed.

In accordance with the ink jet printer of the present invention, when it is detected that one-line printing to a matter to be printed is completed by the ink jet printer head, the ink jet printer controls to bring the piston 12 of the quantifying means provided in the ink jet printer head back to the original position. Consequently, rich gradation printing can be performed line by line at a high speed.

While this description has been in connection with the preferred embodiments of the invention, it will be obvious to those skilled in the art that various changes and modifications may be made. Therefore, to all such changes and modifications as fall within the true spirit and scope of the invention are covered in the appended claims.

What is claimed is:

1. An ink jet printer head, comprising:

a first liquid;

a discharge port for discharging said first liquid;

a second liquid;

an outlet for outputting said second liquid; and quantifying means for measuring said second liquid, said quantifying means including a liquid chamber having a volume to be filled with said second liquid, wherein said quantifying means measure said second liquid by changing the volume of said liquid chamber;

said discharge port and said outlet are positioned to form a predetermined angle; and said first liquid and said second liquid are mixed after being discharged.

2. The ink jet printer head according to claim 1, further comprising discharge means for discharging said first liquid from said discharge port, wherein said discharge means comprises a piezoelectric element.

3. The ink jet printer head according to claim 2, wherein said discharge means comprise a heating element.

4. The ink jet printer head according to claim 1, wherein said predetermined angle is approximately 90°.

5. The ink jet printer head according to claim 1, wherein said quantifying means further comprise a piston which can move up and down in said liquid chamber and said second liquid is quantified by moving said piston.

6. The ink jet printer head according to claim 5, wherein said liquid chamber has sides, an inside and an outside and wherein said printer head further comprises:

an air deflation channel for allowing air in said liquid chamber to escape, wherein said air deflation channel is located in a side of said liquid chamber and communicates between the outside and the inside of said liquid chamber; and a liquid supply channel for supplying said second liquid, wherein said liquid supply channel communicates between the outside and the inside of said liquid chamber and is located at a position lower than said air deflation channel.

7. The ink jet printer head according to claim 5, wherein said liquid chamber has sides, an inside and an outside and wherein said printer head further comprises:

an air deflation channel for allowing air in said liquid chamber to escape, wherein said air deflation channel is located in a side of said liquid chamber and communicates between the outside and the inside of said liquid chamber; and a liquid supply channel for supplying said second liquid, wherein said liquid supply channel communicates between the outside and the inside of said liquid chamber and is located at a position higher than the position of said air deflation channel.

8. The ink jet printer head according to claim 1, wherein said quantifying means output said second liquid at a timing faster than a timing of discharging said first liquid from said discharge port.

9. The ink jet printer head according to claim 1, wherein an edge water treatment is provided at said outlet.

10. An ink jet printer, comprising:

an ink jet print head comprising:

a first liquid and a second liquid, a discharge port for discharging said first liquid, an outlet for outputting said second liquid, quantifying means comprising a piston and a liquid chamber which has a volume to be filled with said second liquid for quantifying said second liquid and outputting said second liquid from said outlet, wherein said quantifying means quantifies said second liquid by changing the volume of said liquid chamber, said discharge port and said outlet are positioned to form a predetermined angle, and said first liquid and said second liquid are mixed after being discharged from said discharge port and output from said outlet, respectively;

detection means for detecting the completion of one line of printing on a material to be printed with said ink jet printer head; and control means for controlling said piston of said quantifying means to return said piston to an original position when said detection means detect that one line of printing on said material to be printed is completed.

11. The ink jet printer according to claim 10, further comprising discharge means for discharging said first liquid from said discharge port, wherein:

said discharge means comprises a piezoelectric element; and said piston of said quantifying means can move up and down in said liquid chamber and quantifies said second liquid by changing the volume of said liquid chamber.

12. The ink jet printer according to claim 11, wherein said predetermined angle is approximately 90°.

13. The ink jet printer according to claim 11, wherein said liquid chamber has sides, an inside and an outside and wherein said printer further comprises:

an air deflation channel for allowing air in said liquid chamber to escape, wherein said air deflation channel is located in a side of said liquid chamber and communicates between the outside and the inside of said liquid chamber; and a liquid supply channel for supplying said second liquid, wherein said liquid supply channel communicates between the outside and the inside of said liquid chamber and is located at a position lower than the position of said air deflation channel.

14. The ink jet printer according to claim 11, wherein said liquid chamber has sides, an inside and an outside and wherein said printer further comprises:

an air deflation channel for allowing air in said liquid chamber to escape, wherein said air deflation channel is located in a side of said liquid chamber and communicates between the outside and the inside of said liquid chamber; and a liquid supply channel for supplying said second liquid, wherein said liquid supply channel communicates between the outside and the inside of said liquid chamber and is located at a position higher than the position of said air deflation channel.

15. An ink jet printer, comprising:

an ink jet printer head comprising:

a first liquid and a second liquid, a discharge port for discharging said first liquid, an outlet for outputting said second liquid, quantifying means comprising a piezoelectric element and a liquid chamber which has a volume to be filled with said second liquid for quantifying and measuring said second liquid and outputting said measured second liquid from said outlet, wherein said quantifying means measure said second liquid by changing the volume of said liquid chamber, said discharge port and said outlet are positioned to form a predetermined angle, and said first liquid and said second liquid are mixed after being discharged;

detection means for detecting the completion of one line of printing on a material to be printed with said ink jet printer head; and control means for controlling said piezoelectric element of said quantifying means to return said piezoelectric element to an original position when said detection means detect that one line of printing on said material to be printed is completed.

16. The ink jet printer according to claim 15, wherein said predetermined angle is approximately 90°.

17. An ink jet printer, comprising:

an ink jet printer head, comprising:

a first liquid and a second liquid;

a first discharge nozzle for discharging said first liquid from said printer head;

a second discharge nozzle for outputting said second liquid from said printer head; and quantifying means for measuring said second liquid prior to discharge;

wherein said discharge nozzles are positioned to form a predetermined angle; and wherein said first liquid and said second liquid are mixed after being discharged from said discharge nozzles;

detection means for detecting the completion of one line of printing on a material to be printed on by said ink jet printer head; and control means for controlling said quantifying means to return to an original position when said detection means detect that one line of printing on said material is completed.

18. The ink jet printer head according to claim 17, wherein said first discharge nozzle comprises a heating element.

19. The ink jet printer according to claim 17, wherein said predetermined angle is approximately 90°.

20. An ink jet printer head, comprising:

a first liquid;

a discharge port for discharging said first liquid;

a second liquid;

an outlet for outputting said second liquid; and quantifying means including a liquid chamber having a volume to be filled with said second liquid for measuring said second liquid, wherein said quantifying means measure said second liquid by changing the volume of said liquid chamber;

said discharge port and said outlet are positioned to form a predetermined angle; and said first liquid and said second liquid are not mixed until after being discharged from said printer head.

21. An ink jet printer head, comprising:

a first liquid and a second liquid;

a first discharge nozzle for discharging said first liquid from said printer head;

a second discharge nozzle for outputting said second liquid from said printer head; and quantifying means for measuring said second liquid;

wherein said discharge nozzles are positioned to form a predetermined angle; and wherein said first liquid and said second liquid are mixed after being discharged from said discharge nozzles.

22. An ink jet printer head, comprising:

a first liquid and a second liquid, a discharge port for discharging said first liquid, an outlet for outputting said second liquid, and quantifying means comprising a piston and a liquid chamber which has a volume to be filled with said second liquid for measuring said second liquid and outputting said second liquid from said outlet, wherein said quantifying means measures said second liquid by changing the volume of said liquid chamber with said piston.

* * * * *